US006612247B1

(12) United States Patent
Pistner et al.

(10) Patent No.: US 6,612,247 B1
(45) Date of Patent: Sep. 2, 2003

(54) CORRUGATED SHIPPING PALLET

(75) Inventors: William W. Pistner, St Marys, PA (US); Donald W Pistner, St Marys, PA (US); Daniel Pistner, II, Kersey, PA (US); Thomas G. Pistner, St. Marys, PA (US); Dennis H Pistner, St Marys, PA (US)

(73) Assignee: St. Marys Box Co. Inc., St. Marys, PA (US)

( * ) Notice: Subject to any disclaimer, the term of this patent is extended or adjusted under 35 U.S.C. 154(b) by 0 days.

(21) Appl. No.: 10/241,498

(22) Filed: Sep. 11, 2002

(51) Int. Cl.[7] ..... B65D 19/00
(52) U.S. Cl. ..... 108/51.3
(58) Field of Search ..... 108/51.3, 51.11, 108/56.3, 57.18, 57.22

(56) References Cited

U.S. PATENT DOCUMENTS

| | | | | |
|---|---|---|---|---|
| 2,388,730 | A | | 11/1945 | Fallert |
| 2,493,562 | A | * | 1/1950 | Yarman |
| 2,691,500 | A | * | 10/1954 | Baumann |
| 3,007,663 | A | | 11/1961 | Huck |
| 3,434,434 | A | | 3/1969 | Horton, Jr. |
| 3,464,371 | A | | 9/1969 | Gifford |
| 3,650,459 | A | | 3/1972 | Tucker |
| 3,661,099 | A | | 5/1972 | Shelor |
| 4,319,530 | A | | 3/1982 | Moog |
| 4,793,519 | A | | 12/1988 | Voorhies, Jr. |
| 4,930,661 | A | | 6/1990 | Voorhies |
| 4,941,309 | A | | 7/1990 | Fluent et al. |
| 5,024,045 | A | | 6/1991 | Fluent et al. |
| 5,076,176 | A | * | 12/1991 | Clasen |
| 5,267,663 | A | | 12/1993 | Dykhouse |
| 5,269,219 | A | | 12/1993 | Juvik-Woods |
| 5,411,786 | A | | 5/1995 | Kuo |
| 5,433,156 | A | | 7/1995 | Hutchison |
| 5,495,810 | A | * | 3/1996 | Yoshii |
| 5,509,620 | A | | 4/1996 | Crews |
| 5,595,125 | A | | 1/1997 | Bridges, Jr. |
| 5,784,971 | A | | 7/1998 | Chang |
| 5,797,832 | A | * | 8/1998 | Ong et al. |
| 5,832,841 | A | * | 11/1998 | Crews et al. |
| 5,934,202 | A | | 8/1999 | Lai |
| 5,941,177 | A | | 8/1999 | Anderson |
| 6,070,726 | A | * | 6/2000 | Graham |
| 6,076,475 | A | * | 6/2000 | Kuhn et al. |
| 6,357,364 | B1 | | 3/2002 | Maloney et al. |

FOREIGN PATENT DOCUMENTS

| | | | |
|---|---|---|---|
| JP | 6-115549 | * | 6/1994 |

* cited by examiner

*Primary Examiner*—Jose V. Chen
(74) *Attorney, Agent, or Firm*—Hudak, Shunk & Farine Co. LPA

(57) ABSTRACT

A lightweight pallet, which can be manufactured from corrugated paper or similar materials which are recyclable, is disclosed for carrying goods and materials. The pallet includes an upper deck member, lower deck member and a plurality of support members connected therebetween. The deck members are independently disposed at a horizontal plane substantially parallel to each other as well as a ground surface. The support members are formed from a continuous wind of a single sheet of corrugated paper to, provide strength and rigidity to the pallet.

20 Claims, 3 Drawing Sheets

CORRUGATED SHIPPING PALLET

FIELD OF THE INVENTION

The present invention relates to a pallet or load carrying structure which can be manufactured from corrugated paper or similar materials which are recyclable. The pallets are utilized to carry goods, materials, etc. and are advantageously lightweight, thus saving transportation costs. The structure of the pallet provides excellent stability and yet allows for production costs to be minimized.

BACKGROUND OF THE INVENTION

A pallet is a portable platform generally including a planar horizontal member, which can be used as a base member for stacking, storing, handling and transporting materials or goods. Generally, pallets are constructed from wood and nails or staples. Recently, pallets have also been constructed from paper-based materials and plastics. Pallets generally have openings in the structure thereof to accommodate the forks of a forklift truck, or the like, and allow the pallet to be lifted off a floor.

U.S. Pat. No. 5,269,219 relates to a pallet design for transporting loads fabricated from paper products consisting of a load-supporting deck, a top cover sheet with tuck tabs that provides a fastening and link to the runners, a bottom sheet glued to the deck that provides a solid surface to attach the runners, and runners spaced apart and at the appropriate height to provide access to the forks on a forklift or hand jack.

U.S. Pat. No. 5,595,125 relates to a lightweight, disposable, corrugated paper pallet formed by a plurality of corrugated paper runners, traversing the length of the pallet, each runner enveloped by a continuous corrugated paper inner sheet, which itself is bonded to the lower side of a reinforced corrugated paper top deck and to the upper side of a corrugated paper bottom stabilizing deck.

U.S. Pat. No. 5,784,971 relates to a collapsible pallet assembly structure which includes at least a pair of lengthwise beam members and at least a pair of crosswise beam members formed of a corrugated paper material. Each lengthwise bead member includes a surface plate portion from which a plurality of folded sidewall portions extend downward and at least one wing piece portion projects in substantially coplanar manner. The surface plate portion has formed therethrough a plurality of upper slot holes which communicate respectively with a plurality of lower slot holes formed through the sidewall portions. Each crosswise beam member includes a top plate portion from which a plurality of folded bracket plate portions extend downward. Each bracket plate portion includes a slotted opening that delineates a pair of bracket plate extending sections. Each crosswise beam member is coupled to the lengthwise beam members in a transverse manner with its top plate portions partially overlaying at least one of the lengthwise beam members surface plate portions and with at least one extending section of each bracket plate portion inserted through an upper slot hole of a lengthwise beam member surface plate portion.

U.S. Pat. No. 5,934,202 relates to a paper pallet which includes a bottom deck board made of a corrugated paper board, a top deckboard made of a corrugated paper board, a plurality of paper blocks longitudinally and transversely arranged in rows and connected between the bottom deckboard and the top deckboard, and a plurality of paper packing members respectively adhered between the paper blocks and one of the bottom deckboard and the top deckboard, the packing members each having an elongated base adhered between one of the bottom deckboard and the top deckboard and one row of the paper blocks and pairs of packing flaps bilaterally extended from two opposite long sides of the elongated base and respectively adhered to the corresponding row of blocks at two opposite sides.

U.S. Pat. No. 6,357,364 relates to a paper pallet comprising support blocks, a top pad and a wrap. The support blocks are of a comb configuration, e.g., honeycomb or hexacomb. The top pad is of a corrugated material and is positioned above the support blocks. The wrap is also of a corrugated material and wraps, via direct contact, the top and side surfaces of the top pad as well as wrapping, via direct contact, at least two side surfaces of the support blocks.

The prior art paper-based pallets present rather complicated designs which are not cost effective to produce and are relatively bulky and heavy. The pallets of the prior art are labor intensive and often not completely recyclable.

SUMMARY OF THE INVENTION

An object of the present invention is to provide a pallet, preferably constructed of corrugated paper, which while being lightweight has sufficient strength to support materials or goods to be transported. Advantageously, the pallet can be recycled and poses no harmful effects on the environment.

A further object of the invention is a pallet structure that is easily customizable and can be manufactured in a vast number of size ranges to suit the varying needs of customers.

The pallet of the present invention generally comprises an upper deck member, a lower deck member, and a plurality of support members connected therebetween. The upper deck member and the lower deck member, independently, are disposed at a horizontal plane substantially parallel to each other as well as a ground surface. The support members comprise a single continuous wind of corrugated paper linerboard, which is preferably single faced, having a continuous layer of paper with strengthening flutes attached thereto. The continuous wind of the support members provides strength and rigidity to the pallet.

In one embodiment, the pallet is constructed from two or more support members which substantially extend the length or width of the deck members and allow two-way access for a forklift truck. In a further embodiment, the support members include access holes perpendicular to the longitudinal axis thereof so that the pallet can be accessed from all four sides for lifting and/or moving.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

The embodiments of the pallet and associated components thereof according to the present invention will be specifically described, with reference to the drawings wherein like numerals indicate like or corresponding parts throughout the Figures.

Figure 1:
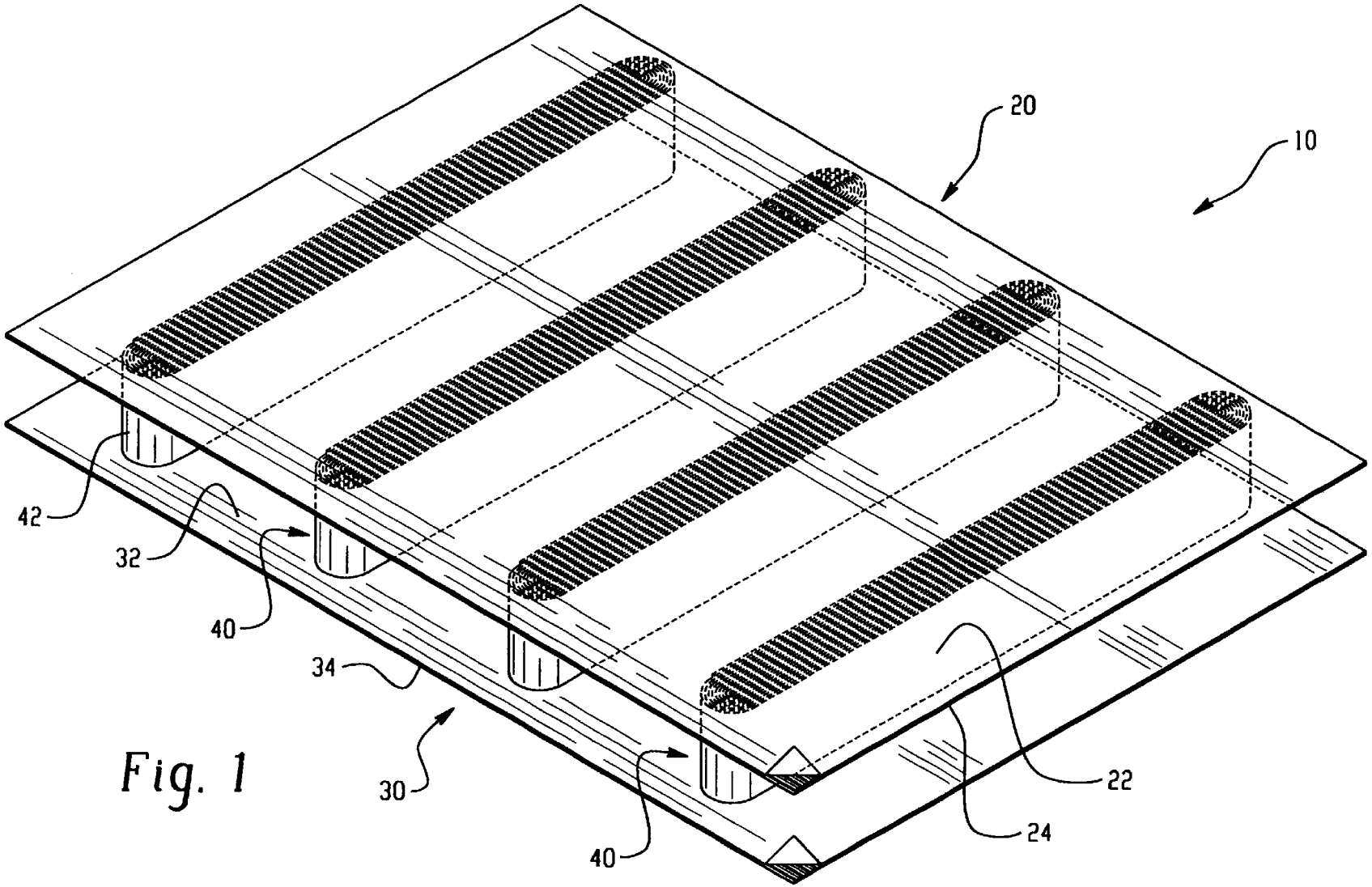
FIG. 1 is a perspective view of a corrugated paper pallet of the present invention showing the upper and lower deck members connected by support members.

FIG. 1 illustrates a pallet 10 of the present invention which comprises an upper or top deck member 20, a lower or bottom deck member 30, and a plurality of support members 40. The support members are secured at predetermined locations between the deck members by a securing means, such as adhesive, tape, fasteners, or the like, with common white glue being preferred.

Figure 3:
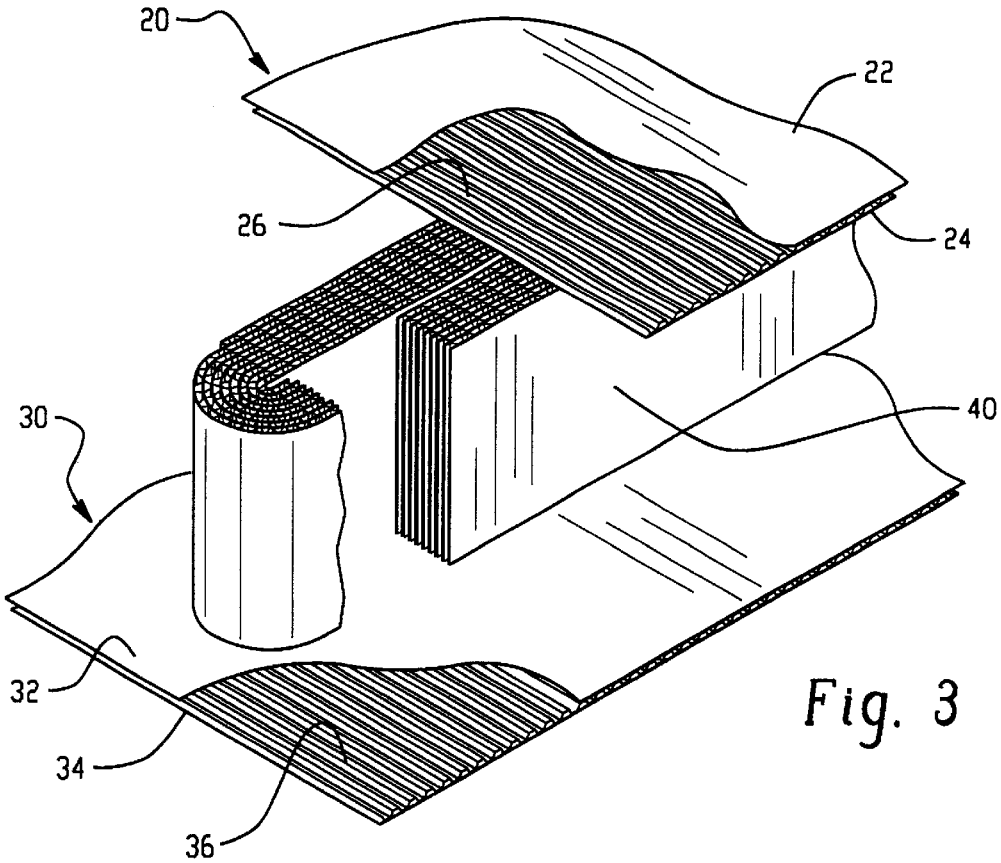
FIG. 3 is a partial perspective view of a pallet with removed portions to particularly illustrate the orientation of the flutes of the corrugated members.

The upper deck member 10 typically serves as a support or load-bearing surface for the goods or materials adapted to be stored on and/or transported by the pallet. The upper deck member is preferably formed from a single sheet of corrugated linerboard paper. The corrugated paper can be single wall, double wall or triple wall. As known in the art, single wall corrugated sheets are formed from two face sheets, 22, 24 connected by a layer of flutes 26, as shown in FIG. 3. The individual double wall and triple wall corrugated sheets include two and three layers of fluting, respectively, each separated by a single layer of thin paper or sheeting, with a layer of the paper or sheeting covering the outer surfaces of the outer flutes. Accordingly, the double and triple wall corrugated sheets have alternating layers of flutes and thin paper layers, with the paper layers being the outer surface of the sheets. The flutes can be described as having a repeating "S" shaped pattern or wave profile. The height of the flutes, i.e., from peak to trough, can vary as known in the art and can be, but are not limited to, A, B, C, and E grade. When double or greater wall corrugated sheet is utilized, different grade and thus different heights of flutes can be used in a single sheet of the corrugated paper, with B and C grade preferred for double wall sheets and A, B, and C; or A, C, and C preferred for triple wall. The flutes of the corrugated sheeting form hollow tube or straw-like passageways and connect the remaining layers together.

Top deck member 20 is a planar structure having a predetermined length and width, with sizes for both ranging generally from about 12 or 14 to about 50 inches, and preferably from about 30 or 40 to about 48 inches.

The main plane formed by the upper deck member is substantially horizontal and parallel to the lower deck member and adapted to be parallel with a ground surface. The top member is maintained a predetermined distance, usually about 3 to about 5 or 6 inches from the lower deck member 30.

The lower deck member 30 can be formed in the same size, manner and construction as the upper deck member 20. Depending on the intended use of the pallet, the corrugated sheets of the upper and lower deck members can be the same or different such as both being single wall corrugated paper, or one member being single wall and the other triple wall, etc. The lower deck member contacts or rests upon the ground surface. The planes formed by the upper and lower deck members are, as noted, substantially parallel and thus provide a level surface for goods or materials.

The support member or stringers 40 of the pallet provide both strength and rigidity to the structure. Each individual support member is formed from a single continuous piece of corrugated paper, such as single face. Alternatively, a plurality of pieces such as generally about 10 or about 8 or less, desirably about 6 or about 4 or less, and preferably about 3 or about 2, can be utilized and the same are butted at their ends to one another, either with or without a fastener such as an adhesive and wound in the same manner as a single continuous piece of corrugated paper. The continuous piece of a predetermined height is wound or wrapped in a direction around itself to form a predetermined length and width or thickness. Support member 40 is preferably formed from single face corrugated paper comprising a single layer of paper with flutes co-extending therewith. Glue or other adhesive is utilized to secure the continuously wound layers to each other. During formation of the support member, the glue is preferably applied to the outer flute edges that will contact the succeeding paper layer. The continuous wind has a continuous nature of alternating layers of flute and liner or paper.

The overall size of a support member 40 can vary with the height ranging generally from about 3 inches to about 5 or about 6 inches, desirably from about 3.5 to about 4 inches, and preferably about 3.5 inches; the width ranging generally from about 2 to about 4 or about 6 inches, desirably from about 2 to about 3 inches, and preferably from about 2 to about 2.5 inches; and the length ranging generally from 12 or 14 to about 50 inches; desirably from about 40 to about 48 inches and preferably from about 46 to about 48 inches.

The support member flutes are arranged parallel to the height of the support member to provide strength. In this manner, the deck members will cover the open ends of the support member, which are then fully enclosed. The overall dimensions of a support member will vary and depend on the intended use and weight the pallet will be used to support.

Often a support member will run substantially the entire length of a pallet from one side or end to another. The number of support members utilized between the deck members will also depend on the weight that needs to be supported, and preferably about 2 or about 3 to about 6 support members are utilized in a pallet.

In a preferred embodiment, the flutes 26, 36 of the deck members 30,40 are disposed in a direction perpendicular to the longest length (as opposed to the width) of the support members, thus providing strength to the pallet as shown in FIG. 3. Thus, the flutes of the support members are perpendicular to the flutes of the deck members. This configuration is also illustrated in FIG. 2 and has been found to provide a lightweight, recyclable pallet which is strong and study in construction.

Figure 2:
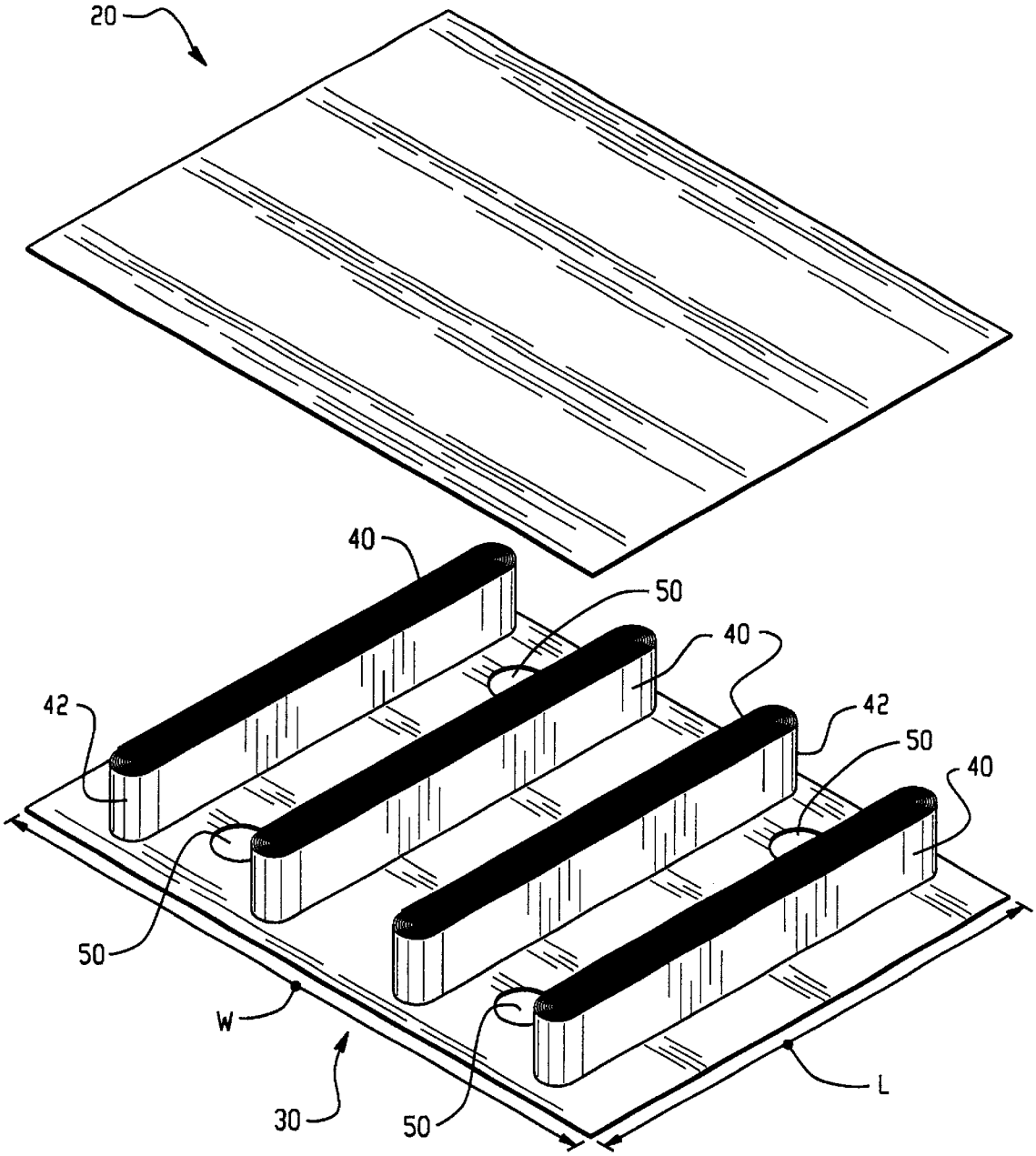
FIG. 2 is an exploded view of a pallet showing the continuous wind or wrap of the support members.

As shown at least in FIG. 2, support members 40 preferably have rounded or curved end portions 42. The curved end portions are adapted to guide the forks of a fork lift truck into the pallet. This is, the curved end portions will allow the forks to slide into the passageways formed between adjacent support members.

FIG. 3 is a detailed cross-sectional view of a pallet of the present invention, particularly illustrating the orientation of the flutes of the corrugated members. The flutes 26 of the upper deck member 20 are orientated in a direction perpendicular to the length of support member 40. The upper deck member is a single wall corrugated paper sheet having face paper layers or sheets 22 and 24 connected by flutes 26. In a similar manner, the lower deck member includes face paper layers or sheets 32 and 34 connected by flutes 36, which are also orientated perpendicular to the length of support member 40.

Figure 4:
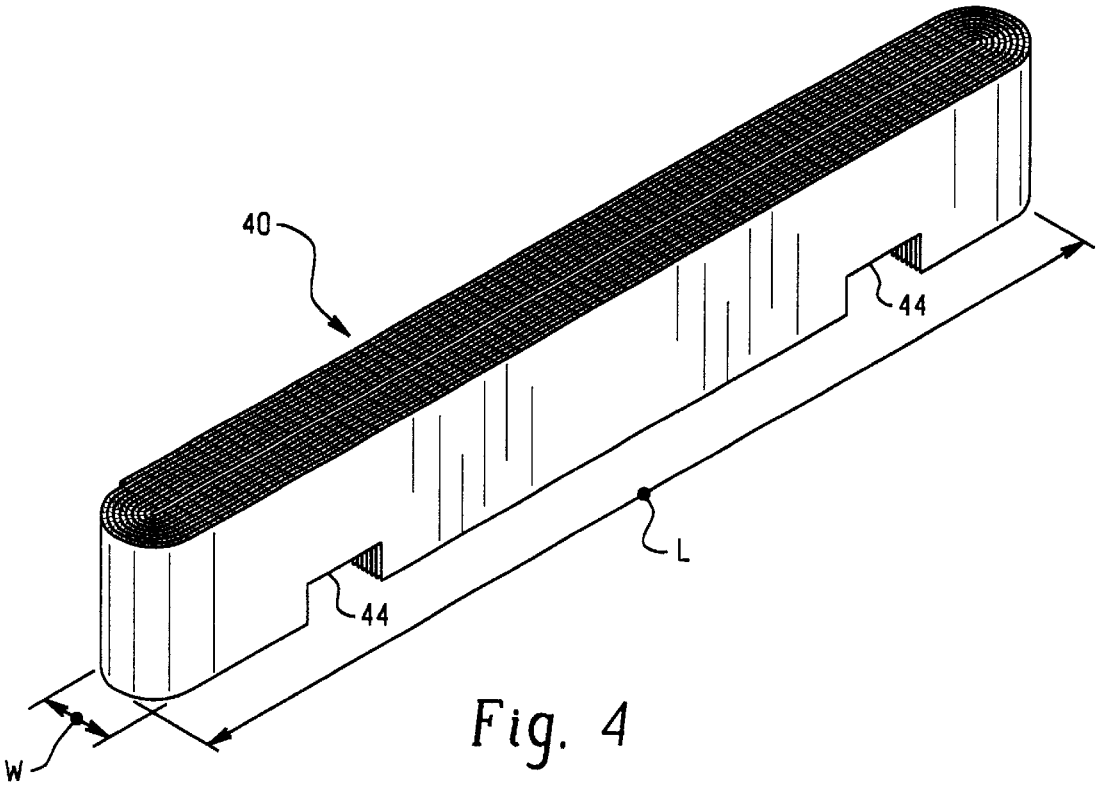
FIG. 4 is a perspective view of a support member of a four-way entry pallet of the present invention.

FIG. 4 illustrates a support member 40 which can be utilized to create a four-way entry pallet. Support member 40 includes at least two cut-outs 44 which extend completely through the width of the support member. The size of the orifice or cut-outs can vary and are at least large enough to accommodate a fork of a fork lift truck. The cut-outs 44 enable the pallet of the present invention to be entered from all four sides for lifting and moving the same.

In a further embodiment, as illustrated in FIG. 2, the lower deck member 30 can have jack holes 50 formed therein to accommodate lift wheels of a hand jack. The jack holes 50 can be formed of any shape or size and are generally at least adapted to be larger than the size of the lift wheels of the hand jack. Jack holes 50 allow the pallets to be utilized and lifted by hand jacks which are generally manually operated. The hand jacks generally include wheels on the fork portions for rolling movement across the ground surface. The jack holes 50 are adapted to allow the wheels of a hand jack to be freely moved, as the wheels are prevented from contacting the pallet 10 due to the presence of the jackholes.

Additionally, either or both of the upper and lower deck members can be treated with an oil and/or water repellent compositions as known in the art and to the literature to prolong the life of the pallet. The pallets of the present invention being formed of corrugated paper are completely recyclable and are thus beneficial to the environment. The construction of the pallet also renders the same insect resistant.

EXAMPLES

Example 1

A two-way entry pallet of the present invention was constructed having an upper deck, a lower deck, and four support members. Both the upper deck and lower deck had dimensions of 40 inches wide by 48 inches long and were formed from a single sheet of single wall corrugated paper, 75-pound version. The support members were each constructed from a single sheet of single face corrugated paper. Glue was applied to the flute edges and the single piece of single face corrugated paper was wrapped around itself to form a support member 3½inches high, 48 inches long and 2 inches wide. Two support members were placed at the width ends with the remaining supports being disposed therebetween at equal distance intervals from the remaining support members. The deck members were adhered to the support members utilizing common white glue.

7,200 pounds of weight was placed on the pallet. The pallet maintained its initial shape and dimensions and did not deform under the pressure of the weight for two weeks when the load was removed.

Example 2

Compression Test

A pallet having the above-noted construction and dimensions as in Example 1 was placed in a gauged hydraulic press. Pressure was then applied to the top and bottom deck members of the pallet and increased incrementally. The pallet withstood 17,000 pounds of pressure before being compressed.

While in accordance with patent statutes the best mode and preferred embodiment have been set forth, the scope of the invention is not limited thereto, but rather by the scope of the attached claims.

What is claimed is:

1. A pallet, comprising;

an upper deck member formed from a corrugated sheet;

a lower deck member formed from a corrugated sheet; and at least two support members, each support member being a solid wind of contiguous layers of one or more corrugated sheets and each said support member having a predetermined height, said support member having a central layer of a predetermined length and additional said contiguous layers wrapped around said central layer, said support members connected to both said deck members so that said deck members are substantially parallel to each other.

2. A pallet according to claim 1, wherein said support member corrugated sheet comprises a single paper layer to which a layer of flutes are attached, and wherein said flutes are arranged in a substantially vertical direction to the plane of said deck members.

3. A pallet according to claim 2, wherein said support member is connected to said deck members with an adhesive or fastener, and wherein each support member, independently, is a wind of about 6 or less of said corrugated sheets.

4. A pallet according to claim 3, wherein said corrugated sheets of said deck members comprise single wall, double wall, or triple wall corrugated sheets.

5. A pallet according to claim 4, wherein said deck member flutes are arranged in a direction perpendicular to the longest length of said support member.

6. A pallet according to claim 5, wherein each support member, independently, is a continuous wind of 2 or less corrugated sheets, and wherein said flutes of said deck members are arranged perpendicular to the flutes of said support members.

7. A pallet according to claim 6, wherein said support members include curved end portions and are formed from a single sheet of corrugated paper, and wherein each said support member length extends substantially the length of said deck members.

8. A pallet according to claim 1, wherein said upper deck member and said lower deck member have a length of from about 12 to about 50 inches and a width of from about 12 to about 50 inches, and wherein said support members have a height of from about 3 to about 6 inches, and wherein each said support member length extends substantially the length of said deck members.

9. A pallet according to claim 1, wherein said lower deck member includes a plurality of jack holes, and wherein each said support member includes at least two cut-outs which extend completely through the width of the support member.

10. A method for forming a pallet, comprising the steps of:

forming a solid support member from a single sheet of corrugated paper by continuously wrapping a predetermined number of contiguous layers around a central layer, said support member having a predetermined height width, and length;

forming at least a second support member; and connecting an upper deck member and a lower deck member to said support members with said support members being disposed between said deck members, said deck members being formed from corrugated sheets.

11. A method according to claim 10, wherein said support member corrugated paper comprises a single paper layer having a layer of flutes attached thereto, and wherein said support member flutes are arranged in a substantially vertical direction with respect to at least one said deck member.

12. A method according to claim 11, wherein said support member is connected to said deck members with an adhesive or fastener.

13. A method according to claim 12, wherein said deck members comprise single wall, double wall, or triple wall corrugated sheeting.

14. A method according to claim 13, wherein said deck member flutes are arranged in a direction substantially perpendicular to the length of said support member.

15. A method according to claim 14, wherein said support members include curved end portions, and wherein each said support member length extends substantially the length of said deck members.

16. A method according to claim 15, wherein a plurality of jack holes are formed in said lower deck member, and wherein each said support member includes at least two cut-outs which extend completely through the width of the support member.

17. A pallet, comprising:

an upper deck member formed from a corrugated sheet;

a lower deck member formed from a corrugated sheet; and a support member comprising one or more pieces of corrugated paper comprising a) a single layer of paper having a length, a width, and a height, and b) flutes connected to said single layer of paper, said flutes arranged parallel to said single layer paper height, said support member being solid and having a central layer of a predetermined length formed from said corrugated paper, and said corrugated paper further wrapped in contiguous layers around said central layer to form said support member having a predetermined height, said support members connected between said deck members so that said deck members are substantially parallel to each other.

18. A pallet according to claim 17, wherein each said support member length extends substantially the length of said deck members.

19. A pallet according to claim 18, wherein each said support member includes at least two cut-outs which extend completely through the width of the support member.

20. A pallet according to claim 19, wherein each said support member is formed from a single piece of corrugated paper.

* * * * *

UNITED STATES PATENT AND TRADEMARK OFFICE

CERTIFICATE OF CORRECTION

PATENT NO. : 6,612,247 B1
DATED : September 2, 2003
INVENTOR(S) : William W. Pistner et al.

It is certified that error appears in the above-identified patent and that said Letters Patent is hereby corrected as shown below:

Title page,
Item [75], Inventors, please replace "Daniel Pistner, II" with -- Daniel H. Pistner --.

Signed and Sealed this

Twentieth Day of January, 2004

JON W. DUDAS
*Acting Director of the United States Patent and Trademark Office*